United States Patent [19]

McCain

[11] 4,397,604

[45] Aug. 9, 1983

[54] RELEASABLE BUCKET AND OTHER TOOL CONNECTION FOR BACKHOE

[76] Inventor: Willard E. McCain, 6431 W. Heidler Rd., Fairview, Pa. 16415

[21] Appl. No.: 314,709

[22] Filed: Oct. 26, 1981

[51] Int. Cl.[3] ..... E02F 3/70

[52] U.S. Cl. ..... 414/723; 414/705; 172/275

[58] Field of Search ..... 280/508, 510; 172/272–275, 677; 414/723, 686, 703, 705, 694, 607

[56] References Cited

U.S. PATENT DOCUMENTS

| | | | |
|---|---|---|---|
| 3,231,116 | 1/1966 | Powell | 414/694 |
| 3,531,140 | 9/1970 | Di Vita et al. | 172/275 X |
| 3,606,052 | 9/1971 | Schurz | 414/723 |
| 3,896,950 | 7/1975 | McCain | 414/694 |
| 4,042,131 | 8/1977 | Buttke | 414/705 X |
| 4,340,240 | 7/1982 | Anderson | 414/703 X |
| 4,341,026 | 7/1982 | Uchida et al. | 414/705 X |
| 4,345,872 | 8/1982 | Arnold | 414/705 |

FOREIGN PATENT DOCUMENTS

| | | | |
|---|---|---|---|
| 1489716 | 6/1967 | France | 172/275 |

*Primary Examiner*—Douglas C. Butler
*Assistant Examiner*—Terrance L. Siemens
*Attorney, Agent, or Firm*—Charles L. Lovercheck; Wayne L. Lovercheck; Dale R. Lovercheck

[57] ABSTRACT

A bucket support for swingably and removably supporting a backhoe bucket on a dipper stick which includes a releasable mechanism for releasing and attaching the bucket from the bucket support. The releasable mechanism is made up of a first forwardly facing hook for receiving the front support pin of the bucket and a downwardly facing notch which receives the rear pin on the bucket, and a second hook attached to the bucket support that swings under the rear pin of the bucket when it is supported in the downwardly facing slot notch.

11 Claims, 6 Drawing Figures

RELEASABLE BUCKET AND OTHER TOOL CONNECTION FOR BACKHOE

GENERAL STATEMENT OF INVENTION

This invention relates to earth working apparatus and more particularly to the type of earth working apparatus commonly known as backhoes.

Backhoes which are made according to present inventions have disadvantages in that the backhoe buckets are generally not readily releasable and detached from the dipper sticks. Applicant has provided a new combination with a backhoe of a tiltable bucket which has means to swing the bucket about an axis passing through the bucket and tractor so that a level bottomed ditch can be dug on a hillside, in combination with a releasable mechanism which can quickly release the bucket from the dipper stick.

It has been discovered that by providing a means for quickly releasing and attaching the bucket on the end of a dipper stick the bucket can be readily transported for repair or to a new location or for compact storage or can be exchanged for another bucket.

REFERENCE TO PRIOR ART

This invention is an improvement on U.S. Pat. No. 3,231,116 which shows a backhoe with tiltable bucket which is not quickly removable from the dipper stick, and U.S. Pat. No. 3,794,195 which shows a front end loader bucket which is quickly removable from the lifting mechanism of a loader. However, the mechanism for removing the bucket from the '195 patent is not suitable for use on a backhoe.

OBJECTS OF THE INVENTION

It is accordingly an object of the present invention to provide a backhoe or the like incorporating an improved means for supporting the bucket thereon.

Another object of the invention is to provide a combination removable bucket, dipper stick and vehicle wherein the bucket can be inclined laterally relative to the vehicle axis.

A further object of the invention is to provide an improved, quick-release bucket supporting means for a backhoe bucket.

With the above and other objects in view, the present invention consists of the combination and arrangement of parts hereinafter more fully described, illustrated in the accompanying drawings and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF DRAWING

Figure 1:
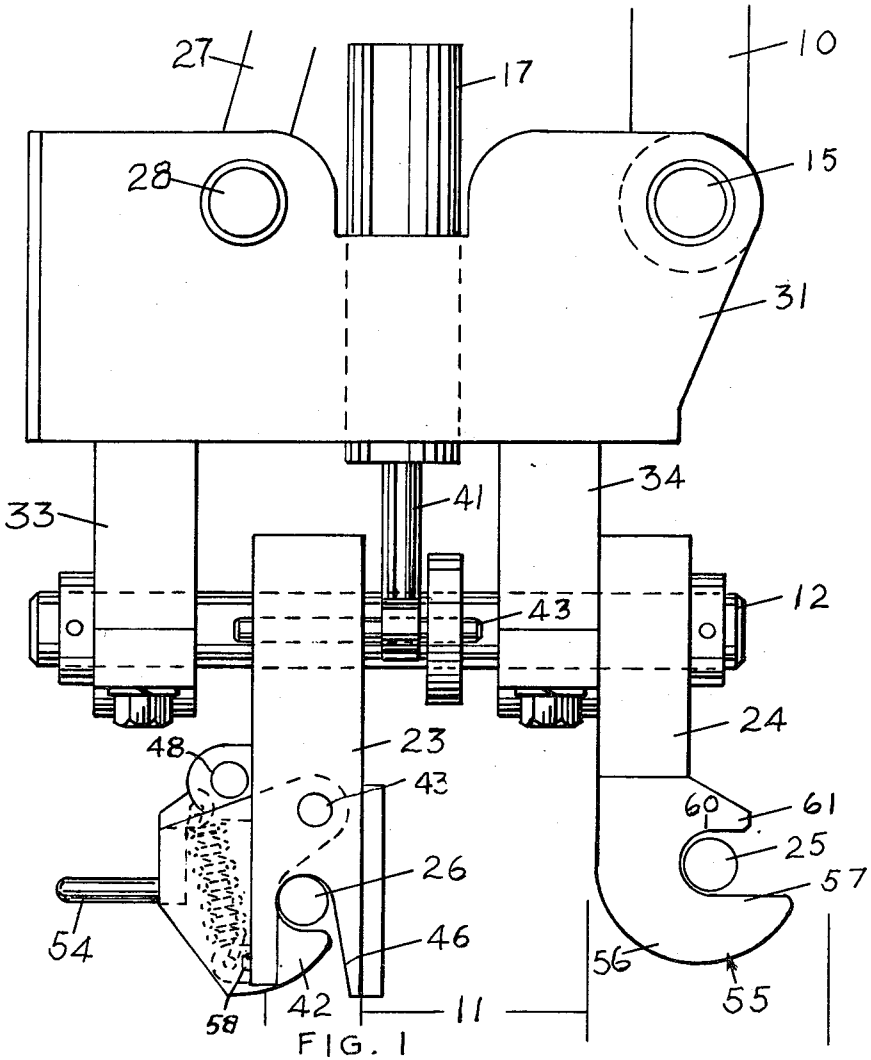
FIG. 1 is a partial side view of the support and release and dipper stick according to the invention.

Now, with more particular reference to the drawings, a backhoe boom is shown having a dipper stick attached to it. The lower end of the dipper stick 10 is attached to bucket support 11 and disposed between and pivoted at 15 to the side plates 31 and 32 of the bucket support plates.

The bucket support plates 31 and 32 are connected by cross plates 30 which have the cylinders 17 pivoted to them by means of pivots 40. The spaced brackets 33 and 34 are fixed to the plates 31 and 32 by welding or other suitable means and they extend downwardly from them and pivotally receive the king pin 12.

The king pin 12 has the collars shown attached to its outer ends to hold the king pin in place. A first carrier 24 is fixed to one end of the king pin 12 and the second carrier 23 is fixed to an intermediate part of the king pin as shown.

The first carrier 24 has a forwardly opening slot 60 in it which may receive a pin 25 on the backhoe bucket. The second carrier 23 has two space support plates 45 attached to its sides and the intermediate support plate 47 is fixed to the rear carrier 23 and extends downwardly between the side plates 45, defining a first space and a second space at each side of the intermediate bracket.

The hooks 42 are supported in the spaces between the intermediate bracket 47 and the hooks 42 and are swingably supported on the side plates 45 and the intermediate support plate by means of the pivot pin 43. Hook 42 has a lower surface that curves downwardly and rearwardly.

The carrier side plates 45 each has a generally upwardly extending slot 46 at its lower ends. Slot 46 has an inclined front surface and a vertical rear surface which receive the pin 26 on the bucket and the hooks 42 swing under the pin 26 and hold it in position. When the bucket support is lowered to bring the pin 26 or a bucket into the space between the front inclined surface defining the slot 46 and the lower curved surface of the hook 42, hook 42 is swung rearward allowing pin 26 to pass to the position shown in FIG. 1. Hook 42 will then swing back to the position shown. Stops 58 are welded to the sides of hook 42 and the stops engage the rear of plates 45 limiting the forward swing of hook 42. The center of the seat in hook 42 is on a vertical line behind the center of pin 43. Thus the weight of the bucket causes hook 42 to swing toward the inclined surface defining slot 46.

A bar 29 is attached at its ends to the hooks 42 and the bar has a handle 54 fixed to it which can be grasped by an operator to swing the brackets away from the pin 26. The first lugs 51 are fixed to the upper end of the bar 16 and the second lugs 49 are fixed to the lower end of the intermediate support 47 and because of the location of lower lugs 49 and upper lugs 51 to pivot 43 the tension springs 52 urge the hooks 42 to swing toward the slot 46 under pin 26 when in the position shown in FIG. 1. When the hooks are swung away from the pin 26, when uncoupling the bucket the pin in hole 47 is removed allowing hook 42 to swing rearward. The forward surface of the slot 46 is inclined downward and away the hook 55, thereby likewise facilitating the operation of the uncoupling and coupling of the bucket. It will be noted that the center of pin 26 is to the left of a vertical line passing through center of pin 43. Thus the weight of the bucket urges hook 42 to latched position. A safety pin can be placed through the hole 48 in the lug shown to lock the hook 42 in closed position.

It will be seen that to release the bucket from the backhoe, it is merely necessary for the operator to move the handle 54 upward thereby swinging the hook 42 from under the pin 26 hold the hook against the force of springs 52 to hold the hook away from the pin 26.

The operator can then lift the link 27 thereby lifting the rear part of the bucket support 31 then swing the bucket support rearwardly thereby moving the hook 55 from under the pin 25 and allowing the hook 55 to be in position so that the entire bucket support can be lifted away from the bucket. The bucket can be recoupled to the machine in a similar manner.

Figure 2:
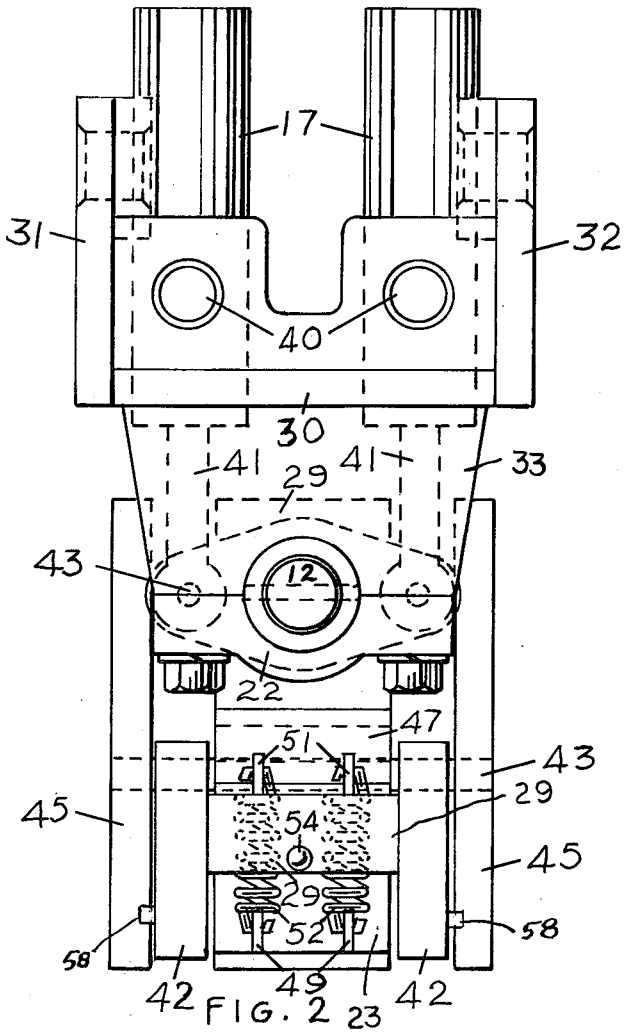
FIG. 2 is a rear view of the bucket support of FIG. 1.
Figure 4:
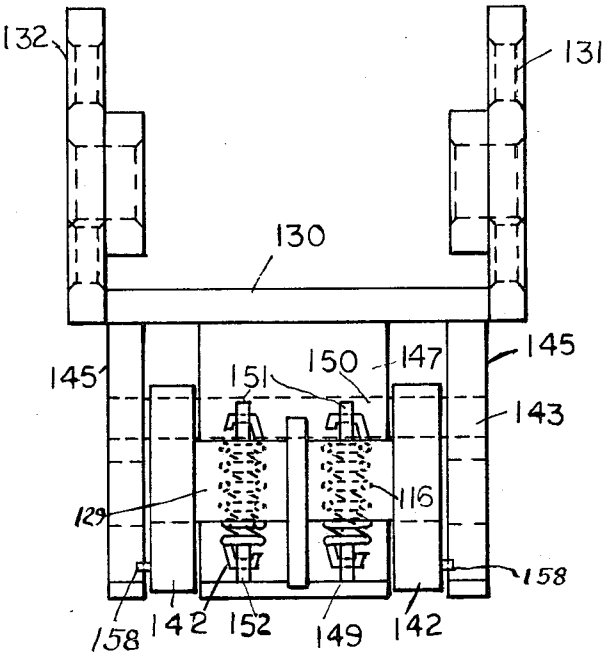
FIG. 4 is a rear view of the embodiment of FIG. 3.
Figure 3:
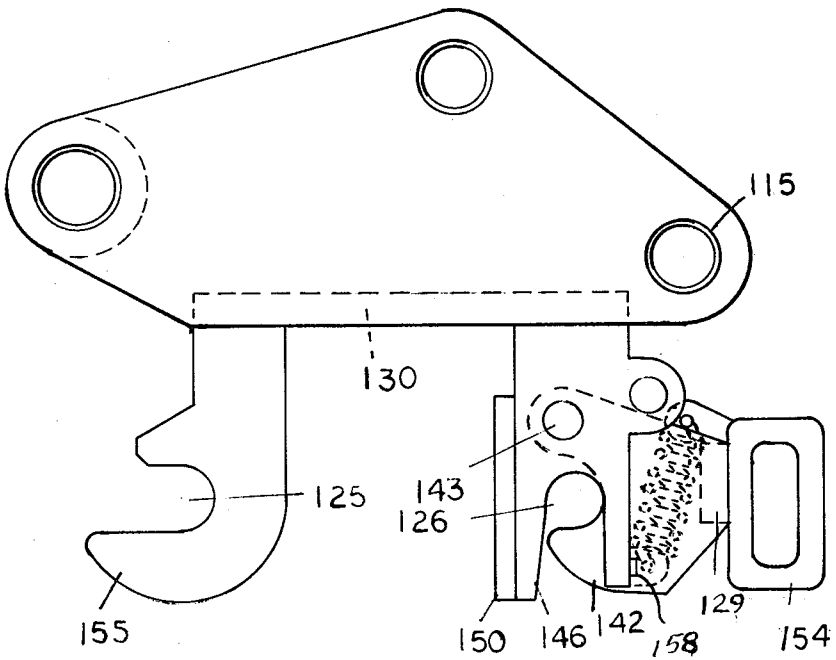
FIG. 3 is a side view of another embodiment of the invention.

In the embodiment of the invention shown in FIGS. 3 and 4, I show a bucket coupling and uncoupling mechanism similar to that shown in FIGS. 1 and 2.

The bucket support has side plates 131 and 132 which have holes 115 and 128 which receive the pins on the dipper stick similar to bucket support 11 and link 27 in FIG. 1. The side plates have a transverse bottom plate 130 which is attached to its ends to the plates 131 and 132 and downwardly extending intermediate plate 147 is disposed between side plates 145. The side plates 145 as well as the intermediate plate 147 are welded to the plate 130. The hooks 142 are swingably supported on the side plates 145 and intermediate plate 147 by the pin 143. A plate is welded at its ends to the hooks 142. Support plates 145 have the slot 146 formed in them which receive the pin 126 of the bucket. Upper lugs 151 are welded to the transverse bar 129 which is welded at its ends to the hooks 142 and the lower lugs 152 are welded to the lower end of the intermediate bar 147. Thus, the tension springs 116 exert a force on hook 142 urging the hook 142 to swing to the position shown in the drawings. A handle 154 is attached to the intermediate part on the bar 129 to provide a handle for swinging the bar and hooks rearward.

Slos 141 in plates 143 are like corresponding slots in FIGS. 1 and 2 and the hooks are similarly contoured. Stops 158 are found on hooks 142 as in FIGS. 3 and 4. A forward hook 155 is welded to the plate 130 to receive the front bucket pin in the area 125. Thus, it will be seen that the embodiment shown in FIGS. 3 and 4 are similar in construction to the embodiment shown in FIGS. 1 and 2 except that the king pin and hydraulic cylinders for swinging the bucket about the king pin are not present in FIGS. 3 and 4.

Figure 6:
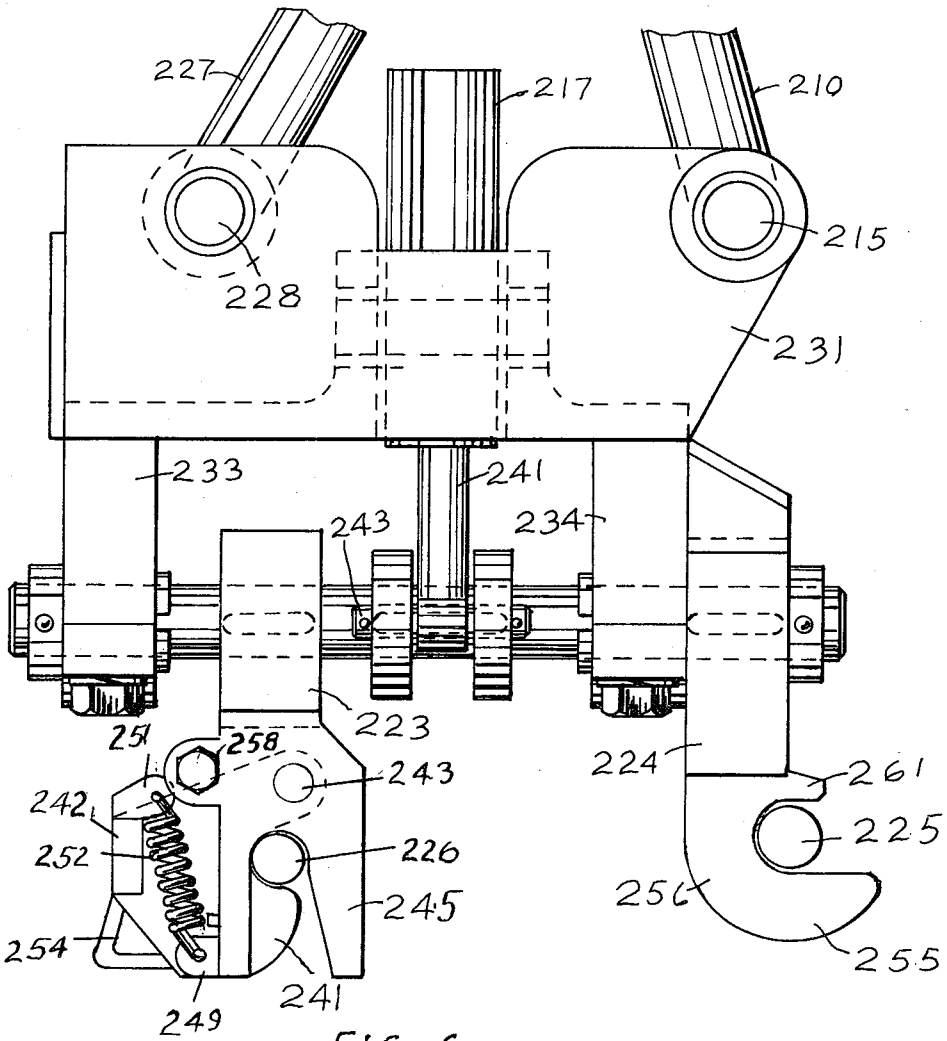
FIG. 6 is a rear view of the embodiment of FIG. 5.
Figure 5:
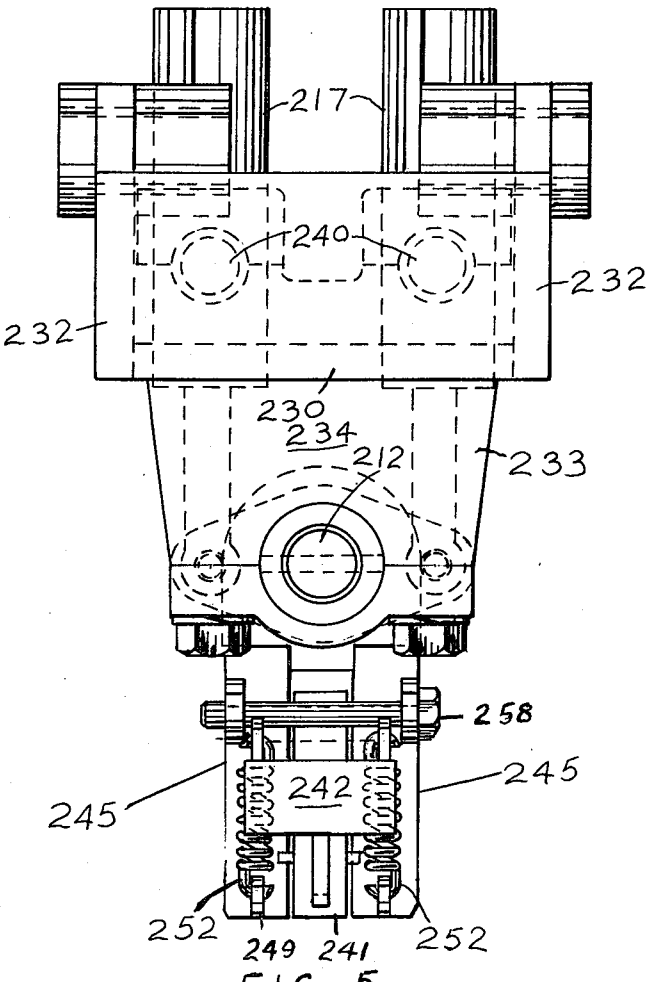
FIG. 5 is a side view of another embodiment of the invention

Now with particular reference to FIGS. 5 and 6. The bucket support plates 231 and 232 have cylinders 217 pivoted to them at 240. The spaced brackets 233 and 234 are affixed to the plates 231 and 232 by welding or other suitable means and they extend downward from them and pivotally receive the king pin 212. The king pin 212 has the collars shown attached to its outer ends to hold the king pin in place. A first carrier 224 and a second carrier 223 are fixed to the king pin 212 as shown. The first carrier 224 has a forwardly opening slot which receives a pin 225 on a backhoe bucket. The second carrier 223 has two spaced support plates 245 which receive a pin 243 which pivotally receives the hook 241. The hook 241 has a plate 242 welded to its rear side and plate 242 has lugs 251 fixed to its upper side which receives the upper end of the springs 252. The lower end of the springs 252 are connected to the lugs 249 which are in turn connected to the rear sides of the plates 245. Therefore, when the operator grasps the handle 254 and swings the hook 241 rearwardly against the force of springs 252 so that the hook member 241 moves from below the pin 226 on the bucket. The bucket support can then be lifted so that the members 245 move up away from the pin 226. When the bucket is to be coupled to the support, the operator will move the bucket support to bring hook 255 below the pin 225 then lower the rear end of the bucket carrier until the pin 226 is received in the slot in the plates of 245 and against the lower curved 241 surface of hook 241. This will force hook 241 to swing rearwardly and allow pin 26 to pass the hook after which springs 252 will return the hook to the position shown trapping the pin in the slot above the hook. Stops 258 are fixed to the sides of hooks 241 and engage the rear edge of plates 245 limiting the swinging of the hook. The center of pin 226 is located rearward of the center of pin 243 so that the weight of the bucket urges the hook to swing forward.

It will be seen that the embodiment of the invention shown in FIGS. 5 and 6 is quite similar to the embodiment shown in FIGS. 1 and 2. The exception is that a single hook 241 is used instead of two hooks 240 in the embodiment of the invention shown in FIGS. 1 and 2.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A bucket support for supporting a bucket on a backhoe dipper stick, said bucket support comprising two spaced, side plates, pivot means for pivotally connecting said side plates to said dipper stick to pivot about a first axis, spaced brackets fixed to said spaced plates and extending downward therefrom, a first carrier and a second carrier spaced from one another and supported on said side plates, said first carrier having a forwardly opening slot in its lower end adapted to receive a pin of a backhoe bucket, said second carrier having two spaced support plates fixed to its sides and extending downwardly therefrom, a downwardly opening slot in each said spaced support plates, at least one hook disposed between said spaced support plates and pivot means swingably connecting said hook to said spaced support plates, said hook having a forwardly opening slot, said hook being adapted to swing under a pin supported in said vertically extending slots, a laterally extending bar attached to said hook and extending laterally thereof and a handle attached to said bar, two spaced helical tension springs attached at their upper end to said bar, the lower end of said springs being attached to means on said support plates, said springs urging said second hook to swing to closed position.

2. A bucket support, king bolt support means on said bucket support for swingably attaching the boom of a backhoe to said bucket support to swing about a first axis, a king pin extending in a direction perpendicular to said first axis, said king pin supported on king pin support means,
means to swing said king pin about its longitudinal axis,
a first carrier and a second carrier supported on said king pin and extending downwardly therefrom,
hydraulic cylinder means on said bucket support to swing said carriers about the axis of said king pin,
said first carrier having a first hook on its lower end adapted to receive a first pin on a backhoe bucket,
said second carrier having spaced downwardly extending plates fixed thereto,
an upwardly extending slot in each of said spaced plates adapted to receive a second backhoe bucket pin,
a second hook disposed between said plates,
a laterally extending bar attached to said hook,
pivot means supporting said second hook on said plates,
first lug means attached to said spaced plates,
second lug means attached to said laterally extending bar,
at least one helical tension spring having a first end and a second end,
first means connecting said first end of said tension spring to said first lug means,
second connecting means connecting said second end of said tension spring to said second hook,
urging said second hook means to swing toward said first hook and under said second backhoe bucket pin,
closing the lower ends of said upwardly extending slots and retaining a said second backhoe bucket pin.

3. The combination recited in claim 2 wherein said means to swing said king pin comprises at least one hydraulic cylinder supported on said bucket support and a crank member is supported on said king pin, and a piston is disposed in said cylinder having a piston rod connected to said crank on said crank pin whereby said bucket can be swung with said king pin.

4. The bucket support recited in claim 2 wherein said upwardly extending slots terminate at their upper end in a seat portion adapted to receive said second bucket pin,
and said second hook is pivoted to said spaced plates at a position above and toward said first carrier from said seat.

5. The bucket support recited in claim 4 wherein said spaced downwardly extending plates have a rigid member rigidly connecting them together.

6. The bucket support recited in claim 2 wherein a stop member is removably supported on said downwardly extending plates and extends laterally of said second hook and is adapted to be engaged by said second hook when said second hook engages said pin thereby limiting the movement of said hook locking said hook in closed position.

7. A tool support for attaching a tool to a boom comprising pivot means for attaching said support to said boom to swing about a first axis,
attaching means for attaching said tool support to said tool,
a king pin and means on said pivot means to swing said king pin about a second axis perpendicular to said first axis,
a first carrier member,
said first member being attached to said king pin and having first downward extending carrier member terminating at its lower end in a forwardly facing first hook,
a second carrier member spaced from said first carrier member and attached to said king pin,
said second carrier having two spaced downwardly extending plate like members attached to said second carrier member and spaced from said first hook member,
a vertically extending slot (245) in each said plate like member,
said slots being open at their lower ends,
said slots being each defined by two spaced generally vertically extending sides comprising a first side and a second side,
said second sides being inclined upwardly and towards said first side and terminating at its top in a generally cylindrical seat for a pin on a tool,
a second hook having a pivot pivotally supporting said second hook on said second carrier to swing about said second hook pivot,
a helical tension spring,
said spring being connected to said second hook adjacent its upper end and to said spaced plates adjacent its lower end urging said second hook to swing towards said second side of said slot,
said hook having a curved side adapted to define with said second side of said slot a generally "V" shaped recess adapted to receive a pin on said tool,
whereby when said tool support is lowered onto a pin bringing said pin into said "V" shaped recess,
said hook is urged rearwardly, allowing said pin to pass said hook and to be received on said cylindrical seat so that said hook can swing under said pin.

8. The tool support recited in claim 7 wherein said hook has stop means on at least one side thereof adapted to engage one of said plates limiting the swinging of said hook toward said second side of said slot.

9. The carrier recited in claim 8 wherein a removable safety pin is supported on said carrier and which when in place in said carrier is disposed behind said hook holding said hook against said stop.

10. The tool support recited in claim 8 wherein the central axis of said generally cylindrical seat is disposed on the side of said slot away said inclined side from the axis of said first pivot means.

11. The tool support recited in claim 7 wherein said pivot means comprises a first pin pivoting said tool support to a boom and a second pivot for pivoting a hydraulic cylinder to said support whereby said tool support can be swung relative to said boom.

* * * * *